US005738282A

United States Patent [19]

Grogan

[11] Patent Number: 5,738,282

[45] Date of Patent: Apr. 14, 1998

[54] PUMP SPRAYER NOZZLE FOR PRODUCING A SOLID SPRAY PATTERN

[75] Inventor: R. Pat Grogan, Downey, Calif.

[73] Assignee: Calmar Inc., City of Industry, Calif.

[21] Appl. No.: 620,855

[22] Filed: Mar. 20, 1996

[51] Int. Cl.[6] ..... B05B 1/34

[52] U.S. Cl. ..... 239/492; 239/333

[58] Field of Search ..... 239/461, 463, 239/490, 491, 492, 333

[56] References Cited

U.S. PATENT DOCUMENTS

| | | | |
|---|---|---|---|
| 3,275,248 | 9/1966 | O'Brien et al. | 239/490 |
| 3,785,571 | 1/1974 | Hoening | 239/492 |
| 4,051,983 | 10/1977 | Anderson | 239/333 X |
| 4,706,888 | 11/1987 | Dobbs | 239/478 |
| 5,152,463 | 10/1992 | Mao et al. | 239/492 X |
| 5,547,132 | 8/1996 | Grogan | 239/492 X |
| 5,593,094 | 1/1997 | Barriac et al. | 239/490 X |

*Primary Examiner*—Andres Kashnikow
*Assistant Examiner*—Robin O. Evans
*Attorney, Agent, or Firm*—Watson Cole Stevens Davis, P.L.L.C.

[57] ABSTRACT

A manually actuated pump sprayer of the type having a discharge nozzle cap in engagement with a probe, spin mechanics formed between the cap and the probe. A generally cylindrical fluid flow dampening chamber, formed at the end of the probe in communication with the spin chamber or being integrated with the spin chamber, has a non-smooth sidewall defined by at least one projection extending toward the axis of the probe for reducing spin energy of the fluid spinning in the dampening chamber and/or in the spin chamber about the axis to effect a solid spray cone of fluid exiting the orifice.

4 Claims, 3 Drawing Sheets

PUMP SPRAYER NOZZLE FOR PRODUCING A SOLID SPRAY PATTERN

BACKGROUND OF THE INVENTION

This invention relates generally to a manually actuated pump sprayer having a discharge nozzle for effecting a fine mist spray, the nozzle including a nozzle cap in engagement with a spinner probe, and spin mechanics provided for imparting a spin at a given velocity to fluid to be discharged through a discharge orifice in the cap.

More particularly, a generally cylindrical fluid flow dampening chamber is either provided at the end of the probe confronting the spin chamber, or is incorporated in the spin chamber, for reducing the spin energy within the spin chamber such that the available atomization energy is reduced, shifting the mean mass particle size larger to effect a solid fill spray cone of the fluid exiting the discharge orifice.

Manually actuated pump sprayers having discharge nozzles of various configurations for imparting a spin at a given velocity to fluid to be discharged through the discharge orifice, are well known. The spin mechanics includes a swirl or a spin chamber having a plurality of tangential grooves or passages intersecting the wall of the spin chamber. A cylindrical spinner probe is engaged by the skirt of the nozzle cap, the spin mechanics being located either at the end of the probe or at the inner face of the nozzle cap confronting the probe. The fluid entering the spin chamber via the tangentials is subjected to a vortex or fluid swirling action adjacent the discharge orifice so that the combined motions of swirling and axial flow through the orifice provide a mechanical breakup of the product and the consequent production of a spray pattern. The spray pattern is of generally conical shape and, depending on the type of liquid product sprayed, the conical spray pattern is annular or hollow thereby producing a donut-shaped spray outline against the target, which is undesirable.

There exists a need for improving upon the quality of spray issuing from the discharge orifice to produce a solid and rounder spray cone of fluid for better wetting the target with those certain fluids known to produce a hollow spray cone.

U.S. Pat. No. 3,785,571 discloses a mechanical breakup aerosol sprayer button which provides a central cavity at the end of a post surrounded by a cup-shaped terminal orifice insert having a swirl chamber confronting the cavity. The cavity is either of conical shape, pyramidal shape or triangular shape. Otherwise, the conically shaped cavity is formed with a plurality of blades or ribs, or is formed with plurality of grooves. The patent suggests that by changing the shape and structure of the conical cavity, the coarseness and spray pattern may be altered to produce a homogeneous or solid spray pattern instead of the common funnel-like spray pattern.

However, test results obtained upon pumping the same liquid product using three of the disclosed post cavity shapes of the U.S. Pat. No. 3,785,571 patent, have demonstrated that the conical spray measured at the target at the same spray distances from the target is in the form of a consistent hollow spray cone for each of the known cavity shapes. Whether an aerosol versus a pump sprayer delivery system accounts for the results which disprove the teachings of the prior art, is uncertain.

SUMMARY OF THE INVENTION

The manually actuated pump sprayer according to the invention has a generally cylindrical fluid flow dampening chamber in addition to or in combination with the spin chamber, the dampening chamber having a non-smooth sidewall defined by at least one projection extending toward the axis of the chamber for reducing the spin energy within the spin chamber such that the available atomization energy is reduced, shifting the mean mass particle size larger to effect a solid fill spray cone of the fluid exiting the discharge orifice. For those fluids having a high surface tension typically exhibiting a funnel-like spray pattern, the dampening chamber provided according to the invention produces a round spray pattern having a filled in center with a larger particle size distribution.

The separate fluid flow dampening chamber may be provided at the end of the spinner probe surrounded by a skirt of the nozzle cap and confronting the spin chamber. Otherwise, the at least one projection may be formed on the cylindrical sidewall of the spin chamber for producing the intended dampening effect.

A plurality of such projections, in various forms and patterns, may be provided on the separate or integrated dampening chamber, and such projection or projections may be formed upon molding the plastic nozzle cap or spinner probe portion.

Other objects, advantages and novel features of the invention will become more apparent from the following detailed description of the invention when taken in conjunction with the accompanying drawings.

DETAILED OF DESCRIPTION OF THE INVENTION

Figure 1:
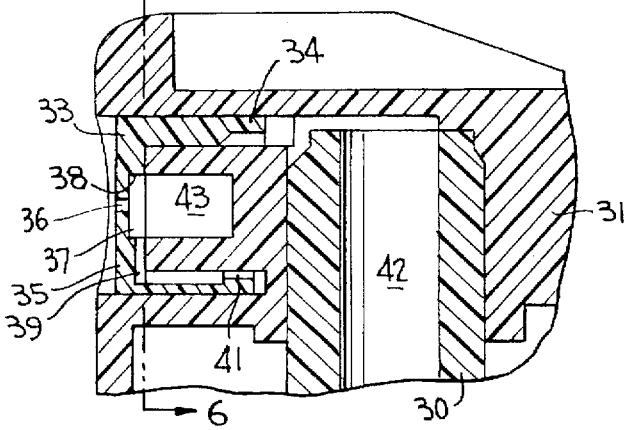
FIG. 1 is a vertical sectional view of a portion of a known manually actuated fingertip pump sprayer incorporating the invention.

Turning now to the drawings wherein like reference characters refer to like corresponding parts throughout the several views, the fingertip actuated pump sprayer partially shown in FIG. 1 is the same as that disclosed in U.S. Pat. No. 4,051,983, except that it incorporates the present invention. The entire disclosure of this patent is specifically incorporated herein by reference.

Figure 3:
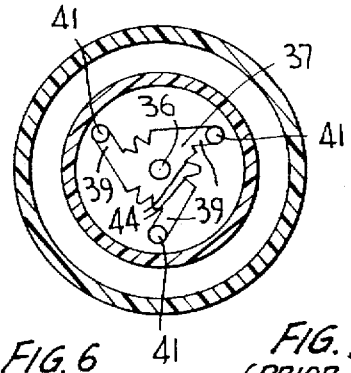
FIG. 3 is a view taken substantially along the line 3—3 of FIG. 2.

The sprayer includes a hollow piston stem 30 on which a plunger head 31 is mounted for reciprocating the piston within its cylinder (not shown). The plunger head includes an integral probe or plug element 32 and a nozzle cap 33 mounted with its skirt 34 about the probe. End wall 35 of the cap includes a central discharge orifice 36, and a spin chamber 37 is formed at the inner face of cap end wall 35 confronting the probe. The spin chamber has a generally cylindrical sidewall 38, and a plurality of tangential grooves 39 (such as shown in FIG. 3) each intersecting sidewall 38 and each connected to a fluid channel 41 in fluid communication with discharge passage 42 defined by the hollow piston stem.

Figure 4:
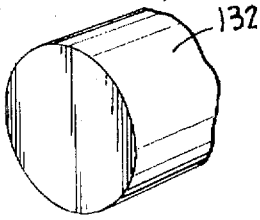
FIG. 4 (PRIOR ART)
FIG. 4 is a perspective view of a solid spinner probe according to the prior art.

The pump sprayer according to the U.S. Pat. No. 4,051,983 is similarly structured as aforedescribed with reference to FIG. 1, except that it has a solid probe 132 as shown in FIG. 4. Thus, upon plunger reciprocation after the pump is primed, liquid product flows under pressure into the spin chamber via the tangentials which creates a thin conical sheet issuing through the discharge orifice. Upon exiting the orifice the conical sheet develops into a typically round spray pattern. For some known liquids, the conical spray pattern is hollow and forms a donut-shaped spray configuration at the surface of the target at certain predetermined distances of the discharge orifice from the target.

According to one embodiment of the invention, probe 32 has a generally cylindrical dampening chamber 43 formed therein coaxial with spin chamber 37 and discharge orifice 36. Dampening chamber 43 is in fluid communication with spin chamber 37, such that chambers 37 and 43 are fluid coupled together.

Figure 6:
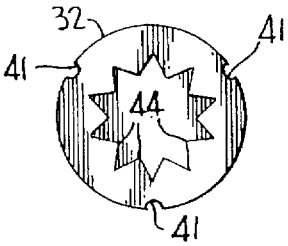
FIG. 6 is an end view taken substantially along the line 6—6 of FIG. 1 of only the spinner probe.

At least one, or a plurality as shown in FIG. 6, projection or projections 44 are formed on the chamber 43 sidewall extending toward the central axis of chamber 43 to thus provide an essentially non-smooth side wall. The plurality of projections may be in the form of a multi-pointed star pattern shown in FIG. 6.

During plunger reciprocation of the FIG. 1 pump sprayer incorporating the invention, fluid enters the combined chambers 37 and 43 via tangentials 39 spinning around the central axis of chamber 43. The spin energy drives the fluid out of the discharge orifice forming a spray. Such spin energy is dampened within the spin chamber due to the viscous fluid couple formed with the fluid in dampening chamber 43 where energy loss occurs as rotational flow encounters projections 44. Since the available atomization energy is reduced the donut-shaped spray pattern exhibited at the target is eliminated, such that a solid spray having a larger average drop size is produced.

Figure 2:
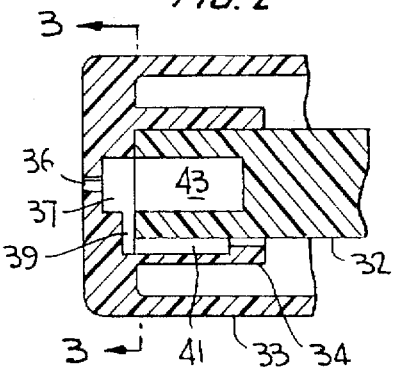
FIG. 2 is a view similar to FIG. 1 of the nozzle portion of a trigger actuated pump sprayer incorporating the invention.

The invention is adaptable for a trigger actuated pump sprayer as well, FIG. 2 showing the end nozzle assembly for such trigger sprayer. Probe 32 is surrounded by skirt 34 of nozzle cap 33 having the spin chamber and tangentials formed in its end wall inner surface. As in FIG. 1 dampening chamber 43 is formed at the end of the probe in the same manner and has a projection or projections 44 on its sidewall to function in reducing the spin energy as in the manner and for the purpose described with reference to FIG. 1.

Alternatively, probe 132 of FIG. 4 can be substituted for probe 32 in FIG. 2, such that chamber 37 is a combined spin and dampening chamber. For this purpose projections 44 on the sidewall of the generally cylindrical spin chamber extend toward the central axis of the chamber to define a non-smooth chamber sidewall. As shown in FIG. 3, one or more projections 44 are located adjacent each tangential 39 in the spin direction of the fluid within the chamber. Again, the fluid entering the chamber under pressure upon trigger actuation with spin energy that is reduced in dampening chamber 43 forms a smaller spray pattern with larger average drop size when issuing through the discharge orifice.

Figure 10:
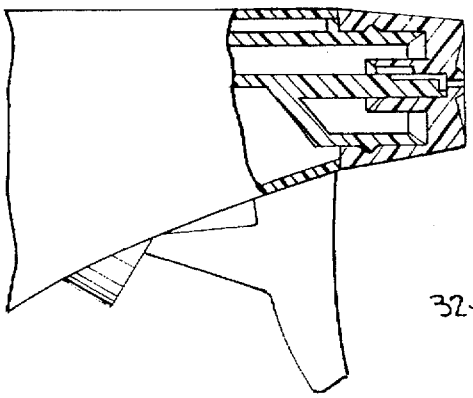
FIG. 10 is a side view, partly in section, of a trigger actuated pump sprayer incorporating the invention.

A slightly different nozzle assembly for a trigger actuated sprayer 45 of FIG. 10 incorporates the invention, sprayer 45 being the same as that disclosed in U.S. Pat. No. 4,706,888, the entirety of which disclosure being specifically incorporated herein by reference.

Figure 11:
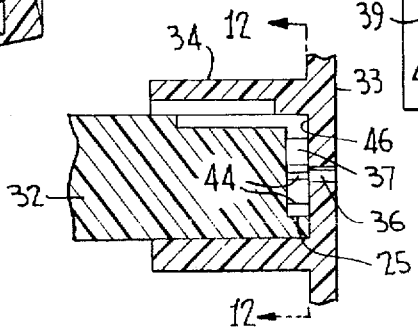
FIG. 11 is a view similar to FIG. 10 of an enlarged cross-section of the nozzle end of the sprayer incorporating the invention.
Figure 12:
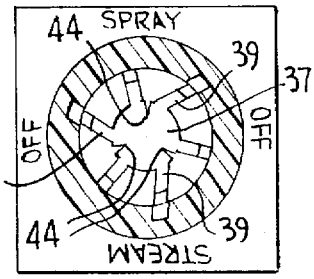
FIG. 12 is a view taken substantially along the line 12—12 of FIG. 11 in one rotated position of the nozzle cap.

Probe 32 has a spin chamber 37 formed at its distal end with tangentials leading into the spin chamber and confronted by a flat surface 46 of the nozzle cap end wall. Chamber 37 is a combined spin chamber and dampening chamber having formed at its cylindrical sidewall one or more projections 44 as shown in FIGS. 11 and 12 to function in the same manner as described with reference to FIGS. 1 to 3, except that the combined spin/dampening chamber is formed at the end of the probe, rather than at the inner face of the end wall of the nozzle cap.

Figure 13:
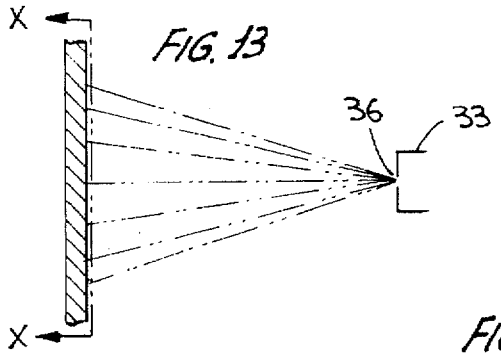
FIG. 13 is a view showing a target surface in vertical section and a conical spray pattern issuing from a nozzle discharge orifice.

Experimentation was conducted using a product of Johnson & Johnson called No More Tangles, the product each time being sprayed against the surface of a target such as 46 (FIG. 13) utilizing the fingertip actuated pump sprayer of FIG. 1. Using laser sheet light imaging technology, and the product being dyed for light intensity enhancement, various spray patterns were photographed at various distances downstream of discharge orifice 36.

Figure 14:
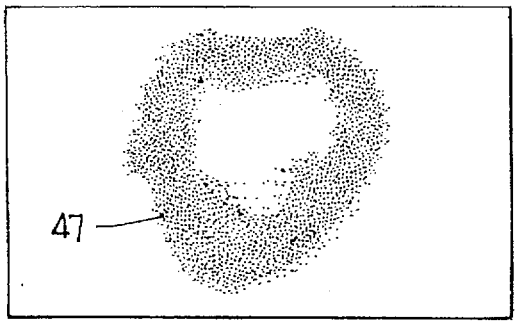
FIGS. 14, 16 and 18 are spray patterns produced according to the prior art, taken substantially along the line x—x of FIG. 13 at various predetermined distances of the discharge orifice from the target.
Figure 15:
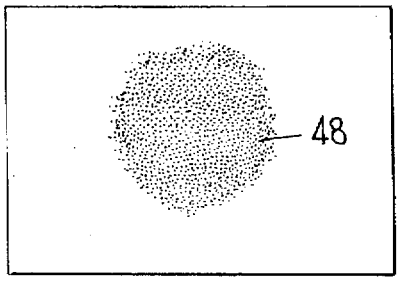
FIGS. 15, 17 and 19 are spray patterns produced according to the invention, taken substantially along the line x—x of FIG. 13 at the same distances of the orifice from the target contrasting the prior art patterns.
Figure 16:
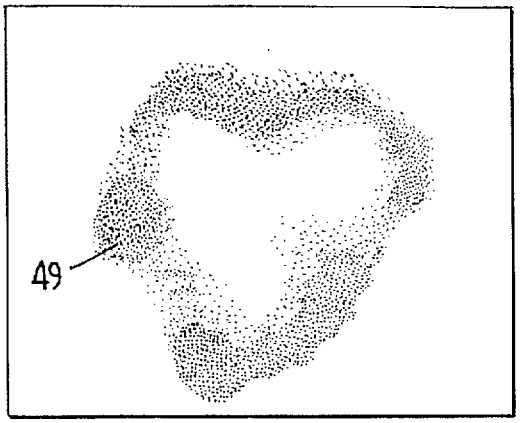
Figure 17:
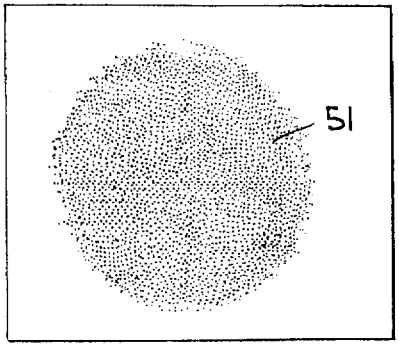
Figure 18:
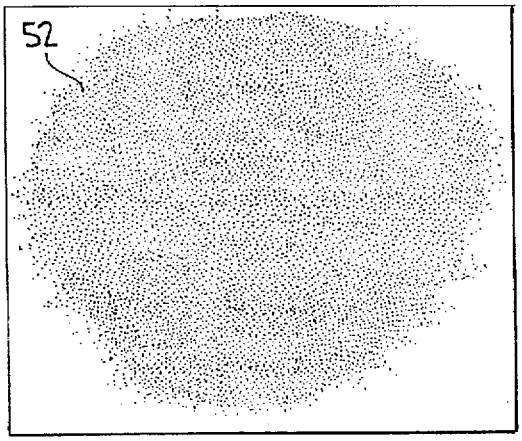

The standard probe 132 of FIG. 4 was used in the FIG. 1 pump to contrast the spray patterns developed at the target surface illustrated in FIGS. 14, 16 and 18. Probe 32 according to the invention, formed with dampening chamber 43 and projections 44 (eight in number) extending from the cylindrical sidewall of the chamber toward the central axis of the chamber, was utilized in the FIG. 1 pump to generate the sprayer patterns of FIGS. 15, 17 and 19.

At 0.5 inch between discharge orifice 36 and the surface of target 46, a spray pattern 47 was generated as shown in FIG. 14 having a distinct hollow core producing a donut-shaped pattern at the surface of target 46. By contrast, for the same 0.5 inch distance from the target, spray pattern 48 was generated at the target in the form of a solid pattern of rounder configuration, more dense and of smaller diameter compared to that of spray pattern 47.

Spray pattern 49 of FIG. 16 was generated at a distance of one inch between the discharge orifice from the surface of the target, using standard probe 132. The donut-shaped spray pattern is to be noted.

At the same one inch distance spray pattern 51 of FIG. 17 was generated which, as can be seen, is a solid pattern, more dense, rounder and of less diameter compared to the FIG. 16 pattern 49.

At a distance of 2.0 inches between the discharge orifice and the surface of the target, the spray pattern 52 of FIG. 18 was generated using standard probe 132 for the FIG. 1 pump sprayer. The pattern is solid although quite irregular and of relatively large diameter. By comparison, spray pattern 53 of FIG. 19 was generated at the same distance with the same liquid but utilizing spinner probe 32 of the FIG. 1 pump sprayer. The smaller size and higher density and improved roundness of spray pattern 53 is noted in comparison to spray pattern 52.

Figure 20:
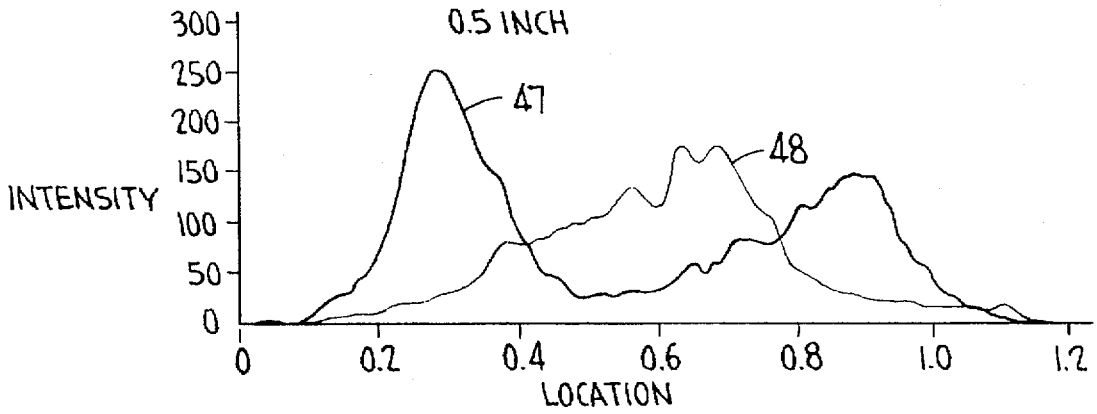
FIGS. 20, 21 and 22 are graphs showing the spray intensity achieved by the spray patterns of FIGS. 15, 17, and 19 contrasting those produced by the spray patterns of FIGS. 14, 16 and 18.

FIG. 20 is a graph of the spray patterns 47 and 48 generated at 0.5 inch between the discharge orifice and the surface of the target, plotted in color intensity along the y axis against location along the x axis. Intensity is light intensity between zero which is all white and 255 which is all black according to the known color scale. The location variables are in inches measuring the diameter of the pattern. As the diameter is approximately 1.2 inches, the center point at 0.6 inches has approximately the greatest color intensity which corresponds to the highest density for pattern 48 at approximately its center point. The color intensity and thus the spray density for spray pattern 47 appears as shoulders for the ringed pattern.

Figure 21:
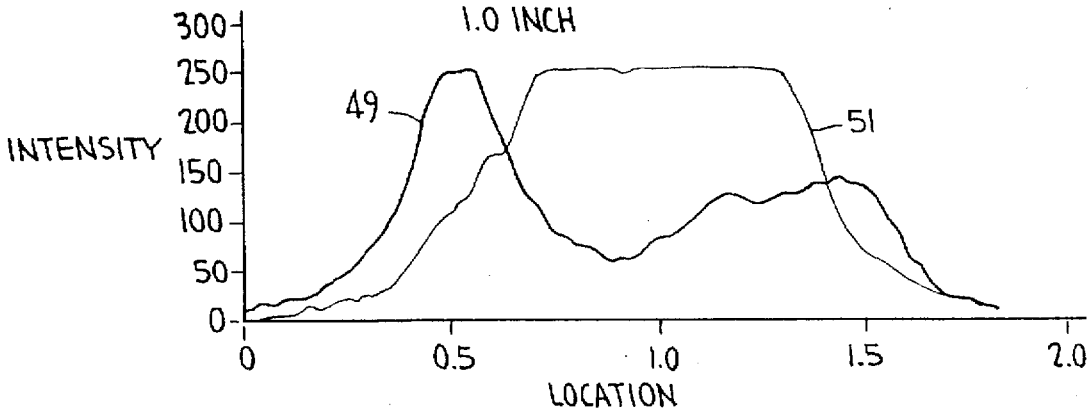
Figure 22:
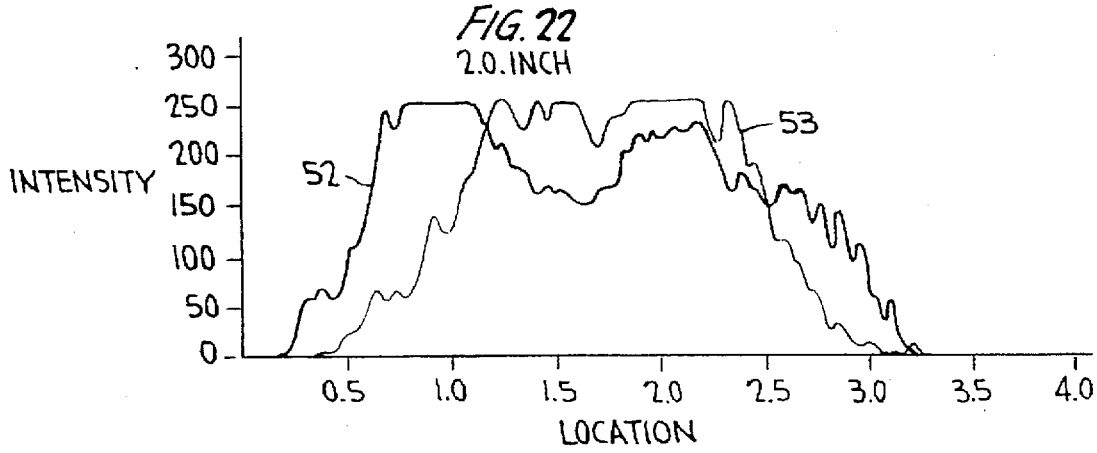

The curves plotted in FIGS. 21 and 22 are based on similar parameters as described for FIG. 20, except that the tops of the curves are flattened at approximately an intensity value of 255 which is all black. In FIGS. 21 and 22 it can be seen that the greatest intensity and thus density of the spray patterns 51 and 53 are contrasted by the high intensity shoulders of spray patterns 49 and 52 illustrating the donut-shape of the pattern.

In the following Table 1 is a tabulation of particle size as a function of probe design as obtained through experimentation by a Malvern Particle Sizer. In carrying out the testing a pump of the FIG. 1 type having a 0.14 cc output was utilized having the same discharge orifice size. The media used was No More Tangles by Johnson & Johnson.

The only variable in the pump structure was the spinner probe in which six different probe designs including that according to the invention were used in each of six pumps. Thus, one of pump sprayers included a standard probe of the FIG. 4 design, another had a hollow probe of the FIG. 5 design, another of the FIG. 7 design, another of the FIG. 8 design, another of the FIG. 9 design, and finally a pump having a probe design according to FIG. 6 of the invention was utilized.

TABLE 1

PARTICLE SIZE AS A FUNCTION OF PROBE DESIGN

Figure 5:
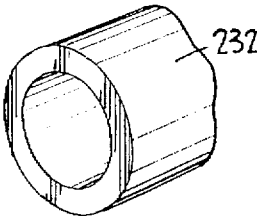
FIG. 5 is a view similar to FIG. 4 of the spinner probe having a hollow, smooth walled cavity.
Figure 7:
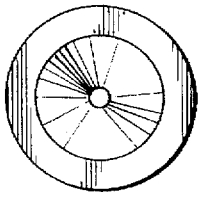
FIG. 7 (PRIOR ART)
FIGS. 7, 8 and 9 are end views of spinner probes according to the prior art.
Figure 8:
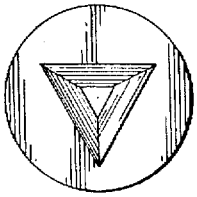
FIG. 8 (PRIOR ART)
Figure 9:
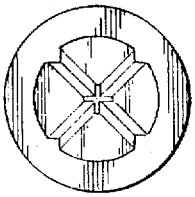
FIG. 9 (PRIOR ART)

| | FIG. 4 | FIG. 5 | FIG. 7 | FIG. 8 | FIG. 9 | FIG. 6 |
|---|---|---|---|---|---|---|
| SMD (D(3,2) | 46.54 | 47.50 | 47.50 | 48.65 | 49.42 | 55.06 |
| ST. DEV. | 3.20 | 1.72 | 1.47 | 1.38 | 2.64 | 2.49 |
| D (v, 0.5) | 57.06 | 58.04 | 57.6 | 59.97 | 60.14 | 67.31 |
| ST. DEV. | 2.95 | 1.47 | 1.57 | 1.30 | 2.98 | 2.31 |

The values listed in Table 1 above indicate Malvern particle size data. The SMD value is Sauter Mean Diameter which is the diameter of the drop whose ratio volume to surface is the same as that of the entire spray. The D(V,0.5) value is the mean mass diameter.

It can be seen that the hollow probe, FIG. 5, did not affect the particle size at all, although a more consistent spray pattern in terms of diameter and roundness was observed using the hollow probe.

The three prior art probes, FIGS. 7, 8 and 9, had little effect in terms of the SMD and the mean mass diameter.

The star hollow probe according to the invention (FIG. 6 values) reduced the average diameter of the spray pattern, shifted the particle size distribution toward larger droplet size, and increased average drop size (SMD and D(v,0.5)) by about 10 microns.

Figure 19:
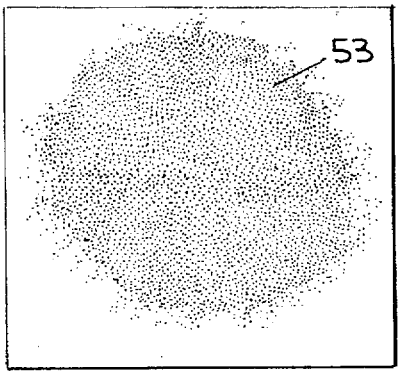

The star hollow probe according to the invention achieved the coarsest particle size as confirmed by FIGS. 15, 17 and 19 in comparison to the results shown in FIGS. 14, 16 and 18 as described above.

Those parts having the dampening chambers with projections formed therein are integrally molded plastic parts, although the invention is not limited to the formulation of projections 44 by molding.

Obviously, many other modifications and variations of the present invention are made possible in the light of the above teachings. It is therefore to be understood that within the scope of the appended claims the invention may be practice otherwise than as specifically described.

What is claimed is:

1. A manually actuated pump sprayer comprising, a pump body having a fluid discharge passage and a probe, a nozzle cap on said probe, said cap having a discharge orifice and means comprising a spin chamber for imparting a spin at a given velocity to fluid to be discharged through said orifice in a predetermined spray pattern; said spin chamber means communicating with said orifice and with said fluid discharge passage, the improvement wherein:

an end of said probe confronting said spin chamber has a generally cylindrical closed fluid flow dampening chamber therein in open communication and coaxial with said spin chamber, said dampening chamber being viscous fluid coupled with said spin chamber, and said dampening chamber having a non-smooth sidewall defined by at least one projection extending toward the axis of said dampening chamber, whereby fluid enters said chambers and spins about the central axis of said dampening chamber developing spin energy which drives the fluid out of the orifice forming a spray, the spin energy being dampened within the spin chamber due to the viscous fluid couple formed with the fluid in the dampening chamber where energy loss occurs as rotational flow of the fluid encounters said at least one projection for reducing the spin energy to effect a solid spray cone of fluid having a consistently round pattern with uniform particle dispersion exiting said orifice.

2. The pump sprayer according to claim 1, wherein said sidewall has a plurality of projections, in a given pattern, extending toward said dampening chamber axis.

3. The pump sprayer according to claim 1, wherein said probe comprises an integrally molded element of said pump body having said at least one projection on said sidewall thereof.

4. The pump sprayer according to claim 2, wherein said probe comprises an integrally molded element of said pump body having said plurality of projections on said sidewall thereof.

* * * * *